US006752202B2

(12) United States Patent
Holm et al.

(10) Patent No.: US 6,752,202 B2
(45) Date of Patent: Jun. 22, 2004

(54) PLATE PACK, HEAT TRANSFER PLATE AND PLATE HEAT EXCHANGER

(75) Inventors: Karl Martin Holm, Lund (SE); Berndt Tagesson, Lund (SE); Nils Inge Allan Nilsson, Veberöd (SE)

(73) Assignee: Alfa Laval Corporate AB, Lund (SE)

( * ) Notice: Subject to any disclaimer, the term of this patent is extended or adjusted under 35 U.S.C. 154(b) by 0 days.

(21) Appl. No.: 10/258,886

(22) PCT Filed: May 18, 2001

(86) PCT No.: PCT/SE01/01101

§ 371 (c)(1),
(2), (4) Date: Oct. 29, 2002

(87) PCT Pub. No.: WO01/90671

PCT Pub. Date: Nov. 29, 2001

(65) Prior Publication Data

US 2003/0094270 A1 May 22, 2003

(30) Foreign Application Priority Data

May 19, 2000 (SE) ..... 0001888

(51) Int. Cl.[7] ..... F28F 3/08
(52) U.S. Cl. ..... 165/167; 165/139; 165/174
(58) Field of Search ..... 165/167, 139, 165/174

(56) References Cited

U.S. PATENT DOCUMENTS

| | | | | |
|---|---|---|---|---|
| 3,976,128 A | * | 8/1976 | Patel et al. | 165/174 |
| 4,153,106 A | * | 5/1979 | Sonoda et al. | 165/174 |
| 4,373,579 A | | 2/1983 | Jernqvist et al. | 165/167 |
| 5,174,370 A | | 12/1992 | Hallgren | 165/167 |
| 5,226,474 A | | 7/1993 | Hallgren | 165/167 |
| 5,388,398 A | * | 2/1995 | Kadambi et al. | 165/174 |
| 5,924,484 A | | 7/1999 | Andersson et al. | |
| 5,964,280 A | * | 10/1999 | Wehrmann et al. | 165/167 |
| 6,164,371 A | * | 12/2000 | Bertilsson et al. | 165/167 |
| 6,478,081 B1 | * | 11/2002 | Shaw | 165/167 |

FOREIGN PATENT DOCUMENTS

| | | | | |
|---|---|---|---|---|
| EP | 0 289 424 | | 11/1988 | |
| FR | 1.128.148 | | 1/1957 | |
| GB | 2 052 723 | | 1/1981 | 165/167 |
| GB | 2 054 124 | | 2/1981 | 165/167 |
| GB | 2056648 A | * | 3/1981 | 165/174 |
| WO | WO 94/14021 | | 6/1994 | |
| WO | 97/15797 | | 5/1997 | |

* cited by examiner

*Primary Examiner*—Leonard Leo
(74) *Attorney, Agent, or Firm*—Fish & Richardson P.C.

(57) ABSTRACT

A plate pack for a plate heat exchanger comprises a number of heat transfer plates (100) having a number of through ports (110*a–d,* 120*a–f*), said plates (100) interacting in such manner, that the plates (100) between them form a first flow duct and a second flow duct and that the ports (110*a–d,* 120*a–f*) form at least one inlet duct and at least one outlet duct (110*a–d,* 120*a–f;* 230, 240; 330, 340; 630, 640) for each of the flow ducts. The inlet duct of at least the first flow duct comprises at least two primary ducts (110*a–b;* 230*a–b;* 330*a–b;* 630*a–b*), which are arranged to receive a fluid flow intended for the first flow duct, and at least one secondary duct (110*c*), which communicates via a flow passage with the primary ducts (110*a–b*) and the first flow duct and which is arranged to receive said fluid flow from the primary ducts (110*a–b*) and to convey this flow to the first flow duct. It is further described a heat transfer plate of the above type, a plate heat exchanger having plates and plate packs of the above type as well as use of a heat transfer plate of the above type in a plate heat exchanger and a plate pack respectively.

28 Claims, 12 Drawing Sheets

PLATE PACK, HEAT TRANSFER PLATE AND PLATE HEAT EXCHANGER

TECHNICAL FIELD OF THE INVENTION

The present invention relates to a plate pack for a plate heat exchanger, comprising a number of heat transfer plates, each of which has a heat transfer portion and a number of through ports, said plates interacting in such manner, that a first flow duct is formed between them in a plurality of plate interspaces and a second flow duct is formed in a plurality of other interspaces and that the ports form at least one inlet duct and at least one outlet duct for each of the flow ducts. The invention further relates to a heat transfer plate for use in a plate pack of the type described above.

BACKGROUND ART

A conventional plate heat exchanger consists of a frame, a pressure plate, a frame plate and a number of heat transfer plates clamped together in a "plate pack". The heat transfer plates are arranged so that their large faces face adjoining heat transfer plates and so that an interspace defining a flow duct is formed between each heat transfer plate. Each of the heat transfer plates is provided with a number of through ports, which together form at least two inlet ducts and two outlet ducts extending through the plate heat exchanger. One of the inlet ducts and one of the outlet ducts communicate with each other via some of the flow ducts and the other inlet and outlet ducts communicate with each other via the other flow ducts.

The plate heat exchanger works by two different media being supplied, each via a separate inlet, to two separate flow ducts, where the warmer medium transfers part of its heat content to the other medium by means of heat transfer plates. The two media can be different liquids, vapours or combinations thereof, so-called two-phase media.

The plate heat exchanger concept will be described in more detail in connection with a plate heat exchanger intended for so-called two-phase application and described in the Alfa Laval AB brochure The plate evaporator from 1991 (IB 67068E)(see FIG. 1).

The medium that is to be completely or partially vaporised, for example juice that is to be concentrated, is supplied to the heat exchanger through an inlet duct located in the lower portion of the plates. The inlet is defined by two openings in the frame plate. These two openings lead directly to said inlet duct, which extends through the entire plate heat exchanger. Vapour is supplied to the flow ducts through the second inlet duct. The second inlet duct is located in an upper corner of the upper portion of the plates and, since the vapour takes up a relatively large volume, the duct has a relatively large cross-sectional area.

When the plate heat exchanger is in operation the vapour flows downwards in its interspaces and is completely or partially condensed. The condensate is discharged through two outlet ducts, which are defined by ports in the two lower corners of the plates and which lead out from the plate heat exchanger via two connecting ports in the frame plate. The second medium is conveyed upwards in its interspaces and is completely or partially vaporised before being finally discharged via an outlet duct, which is located in the other upper corner of the plates and which leads out from the heat exchanger via a connecting port in the frame plate.

A problem associated with this technique is that in long plate heat exchangers, i.e. plate heat exchangers with a large number of heat transfer plates in the plate pack, the media flows tend to vary along the length of the plate heat exchanger. Therefore, the maximum capacity of the plate heat exchanger cannot be exploited. Even if one or several plate interspaces are utilised at maximum capacity, there is a fairly large number of plate interspaces whose utilisation level is considerably below the maximum capacity. This problem is accentuated in two-phase applications, since the vapour phase of each medium is considerably more volatile than the liquid phase, which means that the vapour phase and the liquid phase will behave differently in the heat exchanger and thus present different flows in different plate interspaces of the flow duct concerned. Another problem associated with most plate heat exchangers is that it is difficult, in many cases, to obtain an even distribution of the fluid flow across the whole width of the plate, i.e. across the entire heat transfer portion. One way to try to improve the distribution is to make the inlet duct rectangular, as shown in FIG. 1. To facilitate connection to the other components it is possible to use, for instance, two connecting ports in the frame plate, which connect directly to the rectangular inlet duct. In general, it is undesirable to have such abrupt dimensional variations in a duct, as this causes turbulence in the flow.

The above-related problems arise even if the plate heat exchanger is not being used in two-phase applications. The problems have been discussed in connection with two-phase applications, since they are more pronounced in this kind of application of a conventional plate heat exchanger.

WO97/15797 discloses a plate heat exchanger, which is intended for evaporation of a liquid, for example a refrigerant. This plate heat exchanger has an inlet duct and a distribution duct, which extend through the plate heat exchanger and communicate with each other via a number of flow passages along the length of the plate heat exchanger. The purpose of the distribution duct is, inter alia, to equalize the flow between different plate interspaces by serving as an expansion or equalization chamber between the inlet duct and the plate interspaces. This design does not, however, provide a completely satisfying solution for all operational situations to which a conventional industrial plate heat exchanger may be subjected.

GB-A-2 052 723 and GB-A-2 054 124 disclose two variants of a plate heat exchanger, which are sectioned in a front and a rear section of plate interspaces. To allow the flow to the plate heat exchanger to reach the rear section, these plate heat exchangers are provided with by-pass ducts consisting of a pipe, which is concentrically arranged in the inlet duct. The purpose of the concentric pipe is to convey part of the flow to the rear section. The plate interspaces of the first section communicate directly with the front portion of the inlet duct. The plate interspaces of the second section communicate directly with the rear portion of the inlet duct.

Consequently, there are no prior art constructions, which give a satisfactory flow distribution both along the length of the plate heat exchanger and across the width of the plates. Above all, there is no prior art construction that solves these problems in two-phase applications.

SUMMARY OF THE INVENTION

The object of the invention is to provide a solution, which allows a satisfactory flow distribution along the length of the plate heat exchanger and-across the width of the plates, and by means of which it is also possible to avoid the above distribution problems in two-phase applications.

The present object is achieved by means of a plate pack of the type described by way of introduction, characterised in that the inlet duct of at least the first flow duct comprises at least two primary ducts, which are arranged to receive a fluid flow for the first flow duct, and at least one secondary duct, which communicates with the primary ducts and the first flow duct and which is arranged to receive the fluid flow from the primary ducts and to convey the fluid flow to the first flow duct.

By providing the plate pack with two primary ducts and one secondary duct, a plate pack in which the fluid flow can be advantageously distributed both along the length of the plate pack and across the width of the plates is achieved, while at the same time allowing the plate pack to be easily connected to conventional piping systems without any adverse effects on the flow and without the need for special adapter connections between the plate pack and the conventional piping system. A certain part of a fluid flow conveyed to the inlet duct of the plate pack is deflected from the primary ducts and conveyed to the secondary duct, which extends along the plate pack. The fluid flow deflected from the primary ducts will whirl around in the secondary duct and will thus be evenly distributed along the length of the plate pack. Owing to the use of the primary ducts and the secondary duct, the secondary duct may further be designed to spread the fluid flow across the entire width of each plate, and the primary ducts may be designed to allow conventional, round pipes to be connected to the plate pack. By providing the primary ducts and the secondary duct with a suitable cross-section, the interface between duct and heat transfer surface and the interface between duct and external connections can be designed relatively independently from each other. This means that abrupt dimensional variations in the flow paths can be avoided, and thus also any undesirable turbulence or pressure drops.

By using more than one primary duct, the different ducts can be even more individually designed. To ensure that the secondary duct distributes the fluid flow across the entire width of the plates, said duct advantageously has an elongate shape, which means that its cross-sectional area will most likely be larger than that of a primary duct, which is usually circular. Different combinations of the number of primary ducts allocated to each secondary duct and of the relative size and shape of the ducts are possible for different applications.

Preferred embodiments of the invention are apparent from the dependent claims.

According to a preferred embodiment, a flow distribution device is arranged in at least on of the primary ducts. By arranging a flow distribution device in the primary duct, the size of the fluid flow deflected from the primary duct at different locations along the primary duct can be regulated. The deflecting property of the flow distribution device also stimulates the equalizing fluid flow in the secondary duct.

Each of the primary ducts advantageously extends through the whole plate pack, since this is a simple way of supplying the whole plate pack with fluid.

According to a preferred embodiment, the secondary duct also extends through the whole plate pack. Owing to this design only one secondary duct is needed for the whole plate pack.

According to an alternative embodiment, however, the secondary duct may be divided into a number of separate sections, each extending only through part of the plate pack. This design is particularly suitable in plate packs consisting of a large number of plates, and it makes it possible to obtain an equalization of the fluid flow for a determined number of plate interspaces in the secondary duct. By distributing the equalizing function among a number of separate secondary duct sections, a slightly lower degree of equalization for each of the secondary duct sections can be tolerated, while still obtaining a satisfactory distribution along the whole length of the plate pack, than what would have been possible with a single long secondary duct with the same degree of equalization. This division means that the plate pack can be used in more varying applications without major performance losses.

The flow distribution device suitably delimits a section of the cross-sectional area of the primary duct along a portion of the primary duct concerned in such manner that the cross-sectional area is reduced along the primary duct in the flow direction of the fluid flow. The flow deflected from the primary duct is thereby supplied to the secondary duct in a way that is consistent with fluid technology.

According to a preferred embodiment, the flow distribution device comprises a tubular body surrounding an inclined ramp. The tubular shape of the body allows it to be easily arranged and fixed in the inlet duct of the plate pack. The inclined ramp provides a good deflecting action, since it allows the fluid to flow along the ramp in such manner that its flow direction is gradually redirected.

The front portion of the inclined ramp is advantageously located at a distance from the duct wall of the primary duct. This ensures that the ramp extends into the fluid flow of the duct and deflects part of the flow.

The back portion of the inclined ramp suitably connects to the duct wall of the primary duct adjacent to the flow passage between the primary duct and the secondary duct. This results in the deflected fluid flow being conveyed directly to the secondary duct.

An appropriate way of reliably deflecting a correct share of the fluid flow is to provide the inclined ramp of the flow distribution device with a deflecting edge, which is oriented in a direction opposite to the fluid flow.

According to a preferred embodiment, the deflecting edge extends essentially vertically. This orientation of the deflecting edge is advantageous in that also two-phase flows, such as annular or stratified flows, are divided into approximately equal shares of each of the different phases. This is important since an uneven distribution of vapour and liquid, respectively, both reduces the capacity of the plate heat exchanger and increases the risk of the heat exchanger "running dry", i.e. that the fluid flow between one or several plates is not sufficient, which may cause solid particles in the fluid flow to get burnt and stick to the plates.

The inclined ramp suitably comprises an essentially flat, semi-elliptical sheet. This is a simple way of ensuring the deflecting action of the flow distribution device.

The extension of the inclined ramp along the primary duct is advantageously larger than its largest extension across the primary duct. As a result, the deflection obtained does not cause any extensive turbulence.

According to a preferred embodiment, the flow distribution device comprises a number of outwardly extending connecting means arranged to be fixed between the plates in their abutment against each other round the primary duct. By fixing the flow distribution device in this way no supplementary means for fixing the flow distribution device in the duct are needed. The forces of the tie bars acting to compress the plate pack are thereby also used to fix the flow distribution device.

According to a preferred embodiment of the body, it comprises an open, tubular cage structure, which surrounds and supports the inclined ramp. The body thus surrounding the ramp facilitates a correct positioning of the ramp in the duct. According to a preferred embodiment, the body comprises a pipe, which surrounds the inclined ramp and which is provided with an opening in its circumferential surface, the inclined ramp being connected to said opening. This body design is very robust and does not affect the fluid flow in the duct very much. It also ensures that correct shares of the fluid are conveyed to the secondary duct. The tubular shape ensures that unwanted leaks between primary and secondary ducts are avoided.

The external shape of the flow distribution device suitably corresponds to the internal shape of the primary duct. This means that the flow distributor interferes only to a very small extent with the fluid flow, and because more or less coincident surfaces can be used, that it is easier to obtain a correct positioning.

According to a preferred embodiment, the flow passage between the primary duct and the secondary duct has an extension length along the primary and secondary ducts that is smaller than the extension length of each of the ducts along each other. This construction enhances the tendency of the fluid flow to present an equalizing, circulating flow in the secondary duct, resulting in an excellent distribution across the different plate interspaces communicating with the secondary duct.

According to a preferred embodiment, there is only one flow passage between the primary and the secondary duct. This enhances the tendency of the fluid flow to present an equalizing, circulating flow in the secondary duct.

By using a plate pack of the kind described above in a plate heat exchanger, a plate heat exchanger in which the fluid flow is evenly distributed across the different plate interspaces is obtained. The even distribution will also be obtained in two-phase applications, i.e. when the fluid has both liquid and gas phases. The primary duct, with its flow distribution device, conveys the fluid flow to the secondary duct, where the fluid flow is equalized.

According to a preferred embodiment, the plate heat exchanger comprises at least two plate packs, wherein the primary duct of the first plate pack is connected to and substantially coincides with the primary duct of the second plate pack, and the secondary duct of the first plate pack is separated from the secondary duct of the second plate pack. This construction gives a very favourable distribution of the fluid flow along the length of the plate heat exchanger even if a somewhat less satisfactory distribution would be obtained locally in a plate pack.

BRIEF DESCRIPTION OF THE DRAWINGS

The invention will be described in more detail below with reference to the accompanying schematic drawings, which by way of example show currently preferred embodiments of the invention according to its different aspects.

DETAILED DESCRIPTION OF PREFERRED EMBODIMENTS

Figure 2:
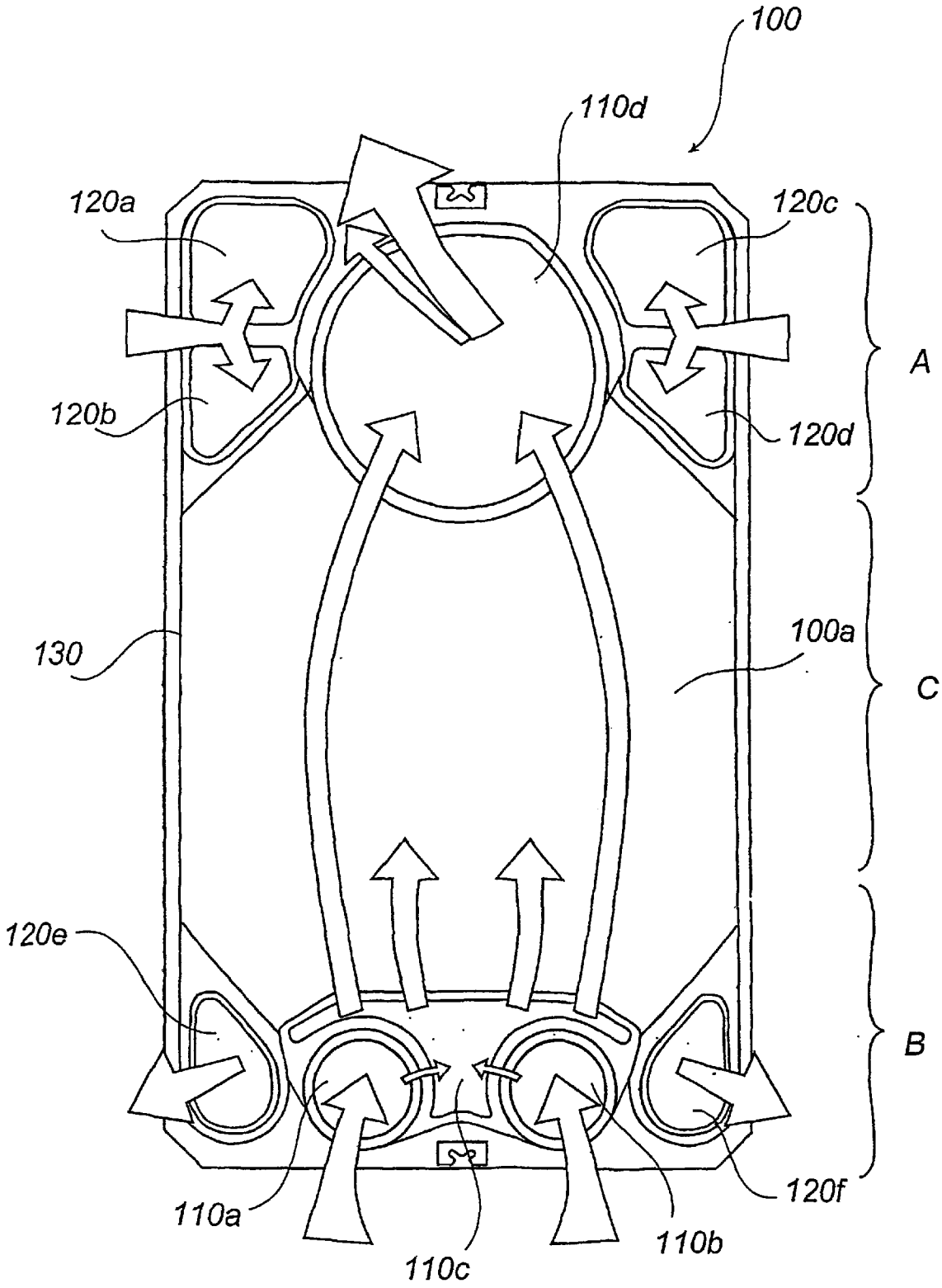
FIG. 2 shows a heat transfer plate for use in a plate pack according to the invention.
Figure 3:
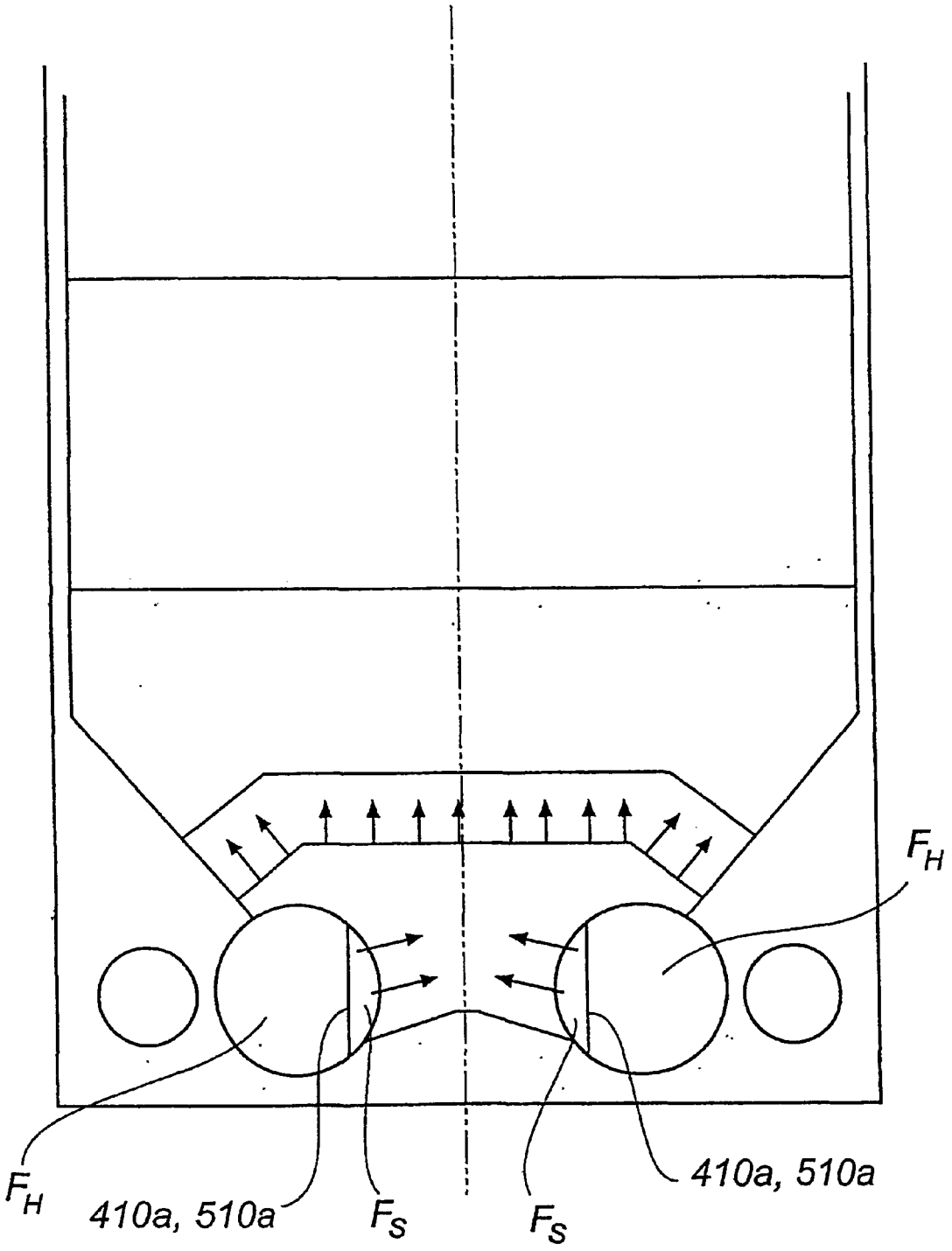
FIG. 3 shows a heat transfer plate and schematically suggests the placement and orientation of a flow distribution device in the primary duct.

As shown in FIG. 2 each of the heat transfer plates 100 comprises an upper port portion A, a lower port portion B and an intermediate heat transfer portion C.

In its lower port portion, the plate 100 has two primary inlet ports 110*a–b* and a secondary inlet port 100*c* for a first fluid as well as two outlet ports 120*e–f* for a second fluid. The two outlet ports 120*e–f* are located at the plate corners. The two primary inlet ports 110*a–b* are located inwardly of the outlet ports 120*e–f*. The secondary inlet port 110*c* has an elongate shape and is located partly between the two primary inlet ports 110*a–b* and between the primary inlet ports 110*a–b* and the heat transfer portion C. The secondary inlet port 110*c* has an elongate shape and extends across the major part of the width of the heat transfer portion C.

In the upper port portion, the plate 100 has two double inlet ports 120*a–b*, 120*c–d* located in the two corners, said ports forming a continuous inlet duct in each of the two corners for the second fluid and a central outlet port 110*d* for the first fluid.

Figure 1:
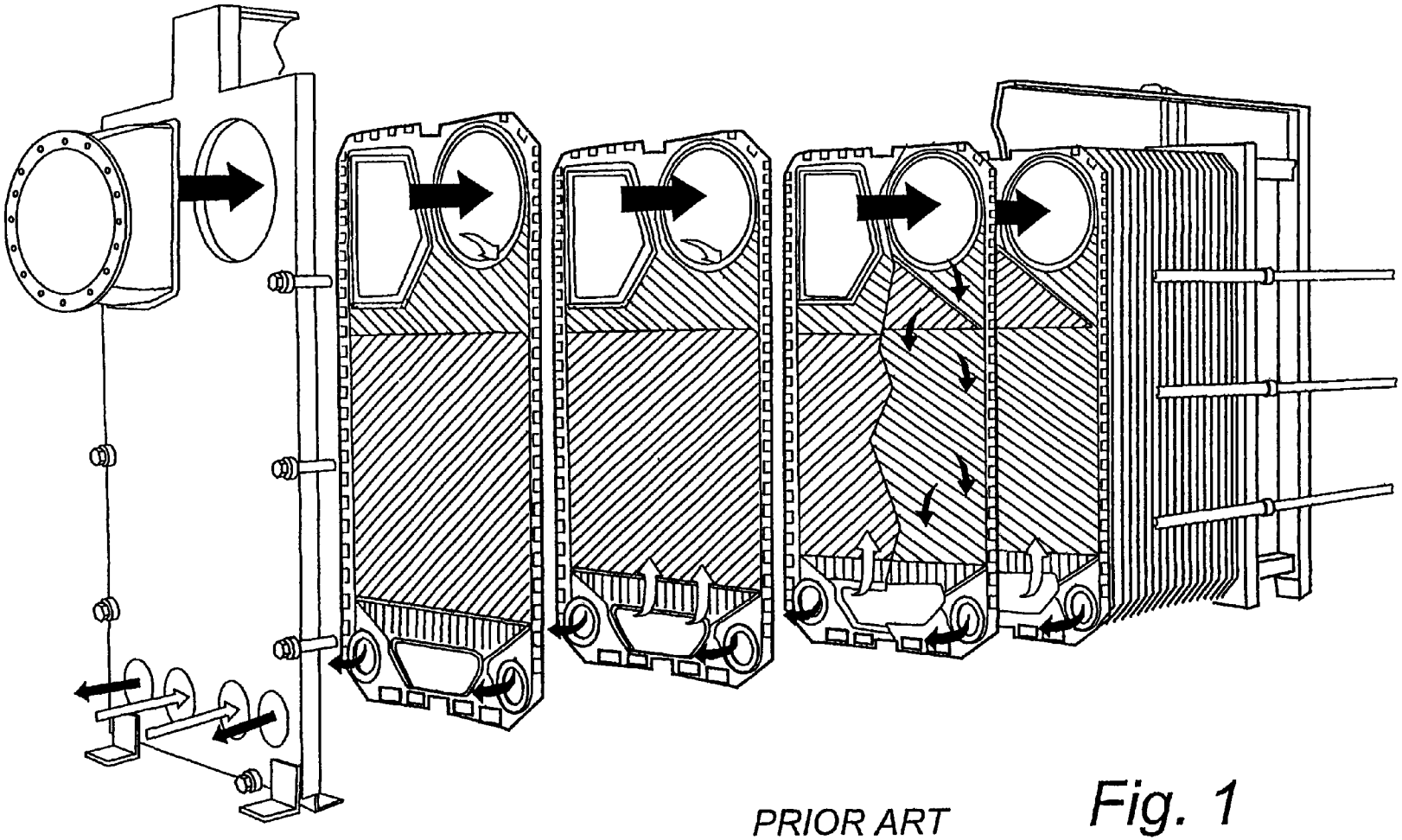
Fig. 1 PRIOR ART
FIG. 1 is a schematic illustration of the operation of a plate heat exchanger according to prior art.
Figure 4:
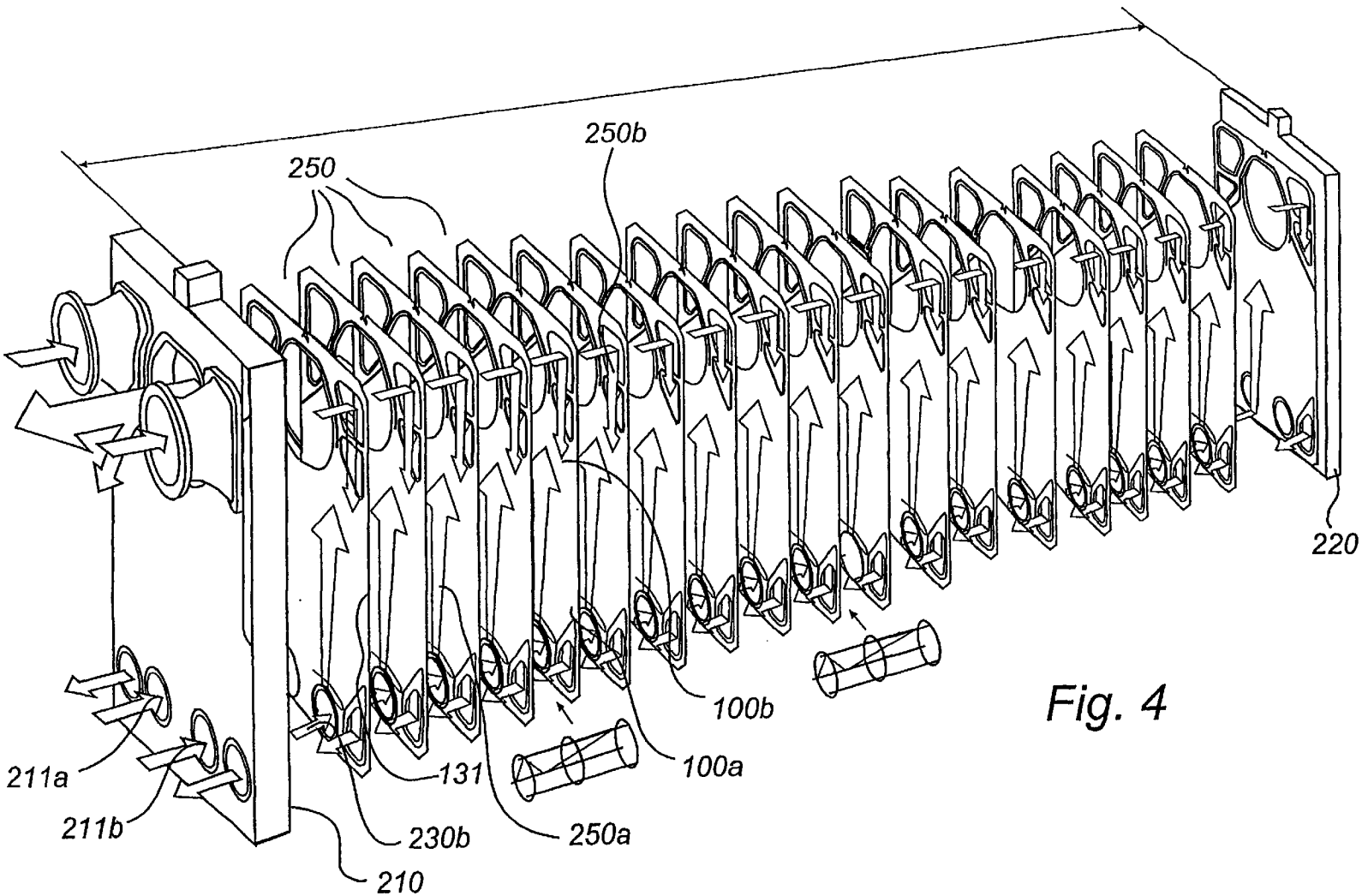
FIG. 4 is an exploded view of a preferred embodiment of a plate heat exchanger according to the invention.

The plate 100 is intended to be arranged in a plate heat exchanger in the way illustrated in FIG. 4. The plate heat exchanger comprises a frame plate 210, a pressure plate 220 and a number of intermediate heat transfer plates 100, which are arranged to be clamped together by means of conventional tie bars (see FIG. 1), which engage the frame plate 210 and the pressure plate 220 and pull them towards each other. The ports 110*a–d*, 120*a–f* of the different heat transfer plates 100 coincide to form inlet and outlet ducts extending through the plate heat exchanger.

The heat transfer plates 100 have gaskets 131 in gasket grooves 130 or elevated beads (not shown) arranged to abut against the adjacent heat transfer plate 100, thereby delimiting the plate interspaces 250 relative to the surroundings. The heat transfer plates 100 also have gaskets or the like, which extend around some of the ports 110*a–d*, 120*a–f* described above. The gaskets around the ports 110*a–d*, 120*a–f* have a different shape on the respective sides 110*a–b* of the plates 100 to allow some of the ports 110*a–d* to communicate with each other along a first side 100*a* of the heat transfer portion C of the plates 100, while the other ports 120*a–f* communicate with each other along the other side 100*b* of the heat transfer portion C of the plates 100.

In addition, the plates 100 have some form of corrugation (not shown), which allows them to abut against each other in a large number of points, so that an inter-space is formed between the plates 100 even when they are compressed between the frame plate 210 and the pressure plate 220.

As shown in FIG. 4, the first fluid is supplied to the plate heat exchanger via two connecting ports 211*a–b* extending through the frame plate 210 and coinciding with the primary inlet ports 110*a–b* of the plates 100. The primary inlet ports 110*a–b* form two primary inlet ducts 230*a–b*, 330*a–b* (see FIGS. 4, 16 and 17) extending through the plate heat exchanger. The first fluid flows from the primary ducts 230*a–b*, 330*a–b* to a secondary duct 240, 230 formed by the secondary ports 110*c*. The primary ducts 230*a–b*, 330*a–b* and the secondary duct 240, 340 communicate with each other via flow passages having a limited extension along the primary and secondary ducts 230*a–b*, 330*a–b*, 240, 340. The secondary duct 240, 340 communicates, in turn, with the plate interspaces 250 that form the first flow duct 250*a*.

Different ways of providing the flow passage having a limited extension will be described below. The limited extension of the flow passage(s) between the primary and secondary ducts 230*a–b*, 330*a–b*, 240, 340 causes a circulating, equalizing fluid flow to form in the secondary duct 240, 340, which results in an even flow distribution across the different plate interspaces 230 along the length of the secondary duct 240, 340, and thereby along the length L of the plate heat exchanger.

Figure 16:
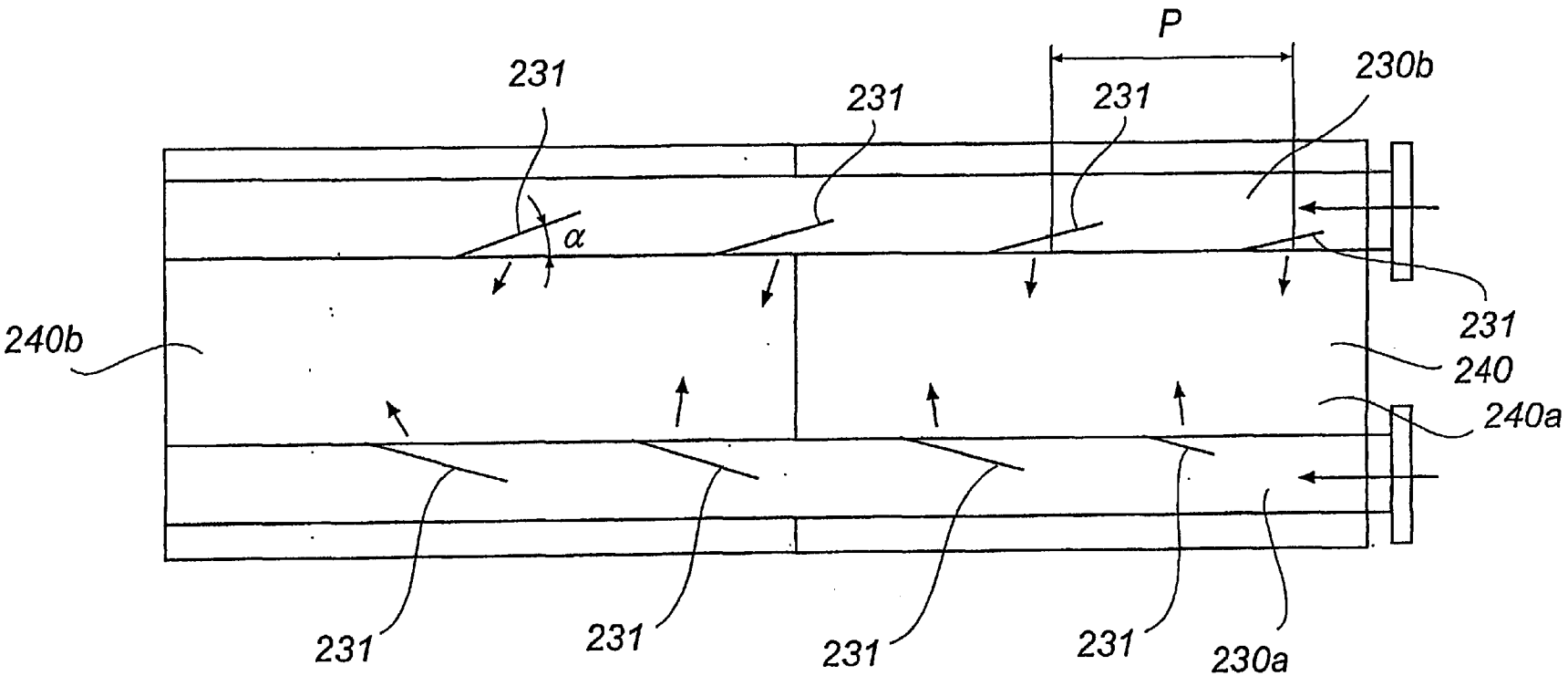
FIG. 16 is a top view illustrating how flow distribution devices are arranged in the primary ducts according to an embodiment of the invention.
Figure 17:
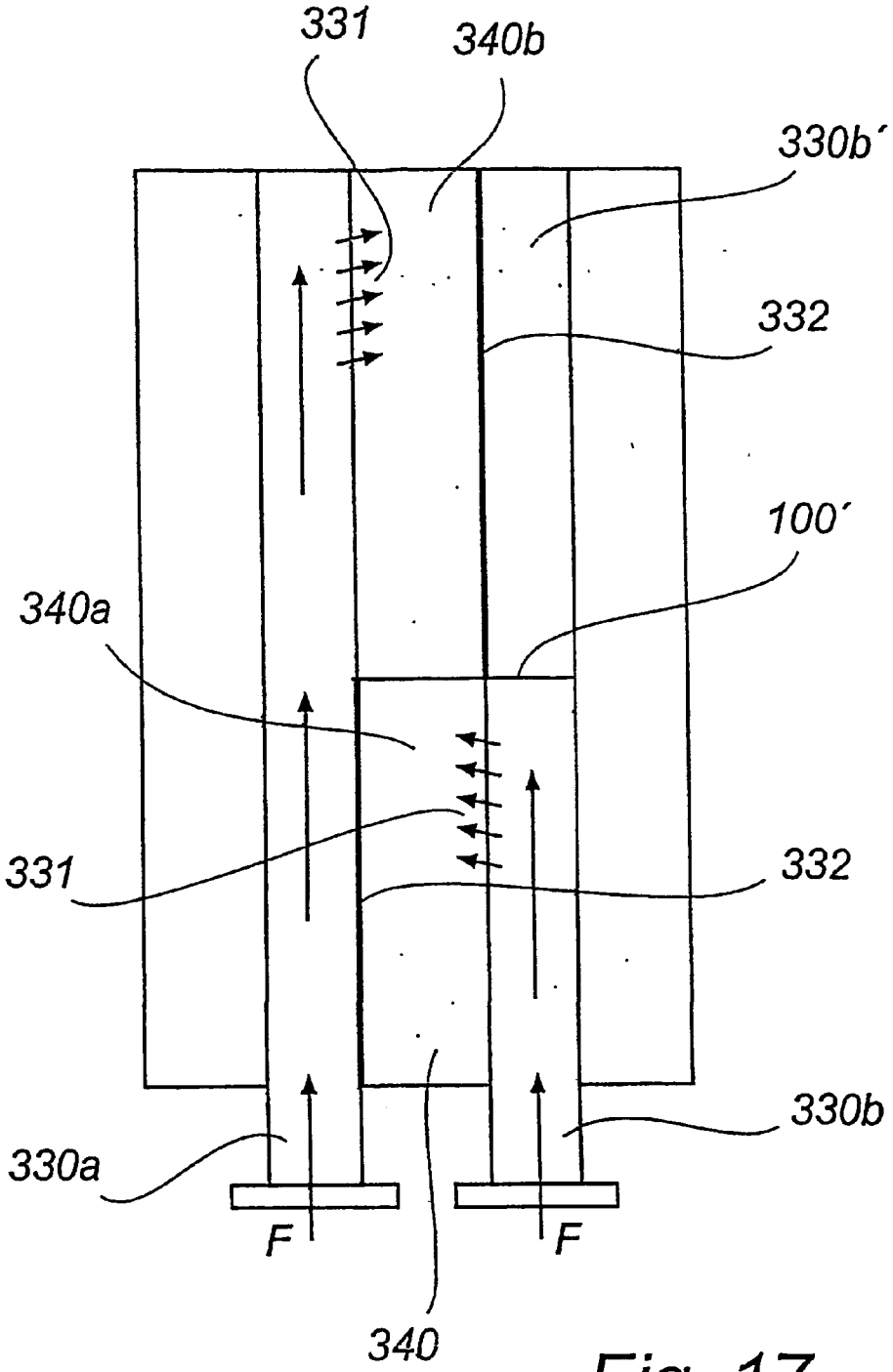
FIG. 17 is a top view of an alternative embodiment with an alternative configuration of the primary and secondary ducts.

The limited extension of the flow passage between the primary ducts 230*a–b*, 330*a–b* and the secondary duct 240, 340 may be achieved for example by means of a flow distribution device 400*a–b*, 500 (see FIGS. 5–8), which is arranged in the primary ducts 230*a–b*, 330*a–b* and which deflects part of the fluid flow in the primary ducts 230*a–b*, 330*a–b* and conveys this part to the secondary duct 240, 340 at certain locations along the extension of the ducts (see FIGS. 16–17).

According to a first embodiment of the flow distribution device 400*a–b* (see FIGS. 5–6), the device comprises a body in the form of a tubular, elongate, open cage structure. The two flow distribution devices in FIG. 5 and FIG. 6, respectively, are variants of each other and the same reference numerals have been used to designate corresponding elements in the two variants. The open cage structure surrounds and supports an inclined ramp 410. The open cage structure comprises a number of rings 411 and a number of elongate struts 412, which serve to interconnect the rings 411. According to both variants, the flow distribution device 400*a-b* comprises three rings 411. In one variant, the flow distribution device 400*a* comprises three struts 412 and in the other the flow distribution device 400*b* comprises four struts 412.

According to a second embodiment of the flow distribution device 500, the device comprises a pipe 501, which has an opening 502 in its circumferential surface. The flow distribution device 500 further comprises an inclined ramp 510, which is arranged to cover the opening 502.

The opening 502 is shaped in such manner that it is defined, in one direction (opposite to the direction F in FIG. 8), by two edges 503*a,b*, which extend from a point on the circumferential surface 501 and whose relative distance then increases as the edges 503*a–b* are located at an increasing distance from each other in the circumferential direction. This means that, at a first end (according to the direction F), the opening 502 encompasses almost half of the circumference of the circumferential surface 501 and, at a second end, the opening 502 is terminated by its edges 503*a–b* converging and connecting to the circumferential surface 501. At the first end of the opening 502, the edge 503 of the circumferential surface 501 as defined by the opening 502 is located at a first radial distance H from the original circumferential surface 501.

By designing the opening 502 in this way and arranging an inclined ramp 510 that covers the recess, a whistle-like structure is obtained. The distance H determines the amount of the flow F in the pipe 501, which is deflected.

Both embodiments of the flow distribution devices 400*a–b*, 500 are intended to be used in the same way. One or more flow distribution devices are arranged in the primary duct in different places along the length of the duct as shown in FIGS. 4, 16 and 17.

The inclined ramp 410, 510 serves the purpose of deflecting part of the fluid flow in the primary duct to the secondary duct. FIG. 3 and FIGS. 9–11 show how the inclined ramp 410, 510 is arranged to be oriented. FIG. 3 and FIGS. 9–11 show the flow distribution device as seen from the flow direction F (see FIGS. 5–8). The deflecting edge 410*a*, 510*a* of the inclined ramp, located in the front portion of the ramp, is located at a radial distance H from the duct wall, through which the flow distribution device is arranged to deflect a partial flow. The deflecting edge 410*a*, 510*a* divides the flow in the primary duct into a main flow FH and a secondary flow Fs, which is intended for the secondary duct.

Figure 10:
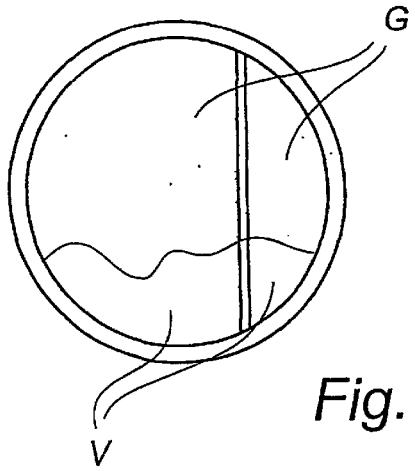
Figure 11:
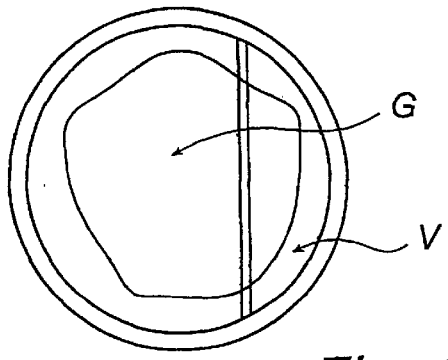

The deflecting edge 410*a*, 510*a* is vertically arranged, which means that it has a favourable distribution function also in two-phase applications (see FIGS. 10–11). Both in a "stratified flow" (where the gas phase is located above the liquid phase) and in an "annular flow" (where a liquid film surrounds the gas phase) the flow distribution devices will deflect substantially the same proportion of the two phases as is present in the main flow FH, which means that distribution problems that otherwise are common in two-phase applications can be avoided. In a traditional plate heat exchanger, the gas phase has a tendency to flow upwards to a great extent through the first plate interspaces. The radial placement of the deflecting edge 410*a*, 510*a* determines to a high degree how much of the fluid flow is deflected.

In addition to the radial distance H of the inclined ramp 410, 510, it is also possible to vary the angle of inclination and its extension along the primary duct. The extension is determined, inter alia, by the extension of the flow passage between the primary and the secondary duct. The extension is also determined by the maximum angle of inclination that can be used without undesirable turbulence and pressure drops being introduced. The inclination in turn is dependent on the radial placement of the deflecting edge and the extension of the ramp. Each selection of parameter value is thus influenced by the other parameter value selections and by the application in which the plate heat exchanger is to be used. According to a preferred embodiment, the inclined ramp 410, 510 has an angle of inclination $\alpha$ of 15° (See FIG. 16).

Figure 5:
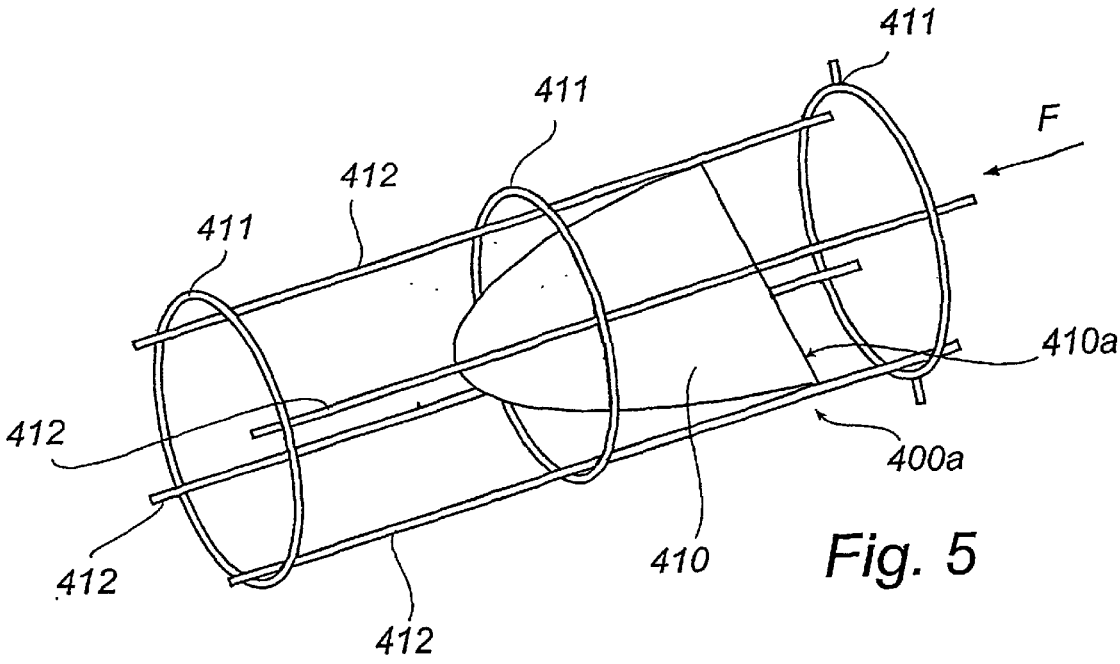
FIG. 5 shows a flow distribution device according to a first preferred embodiment.
Figure 6:
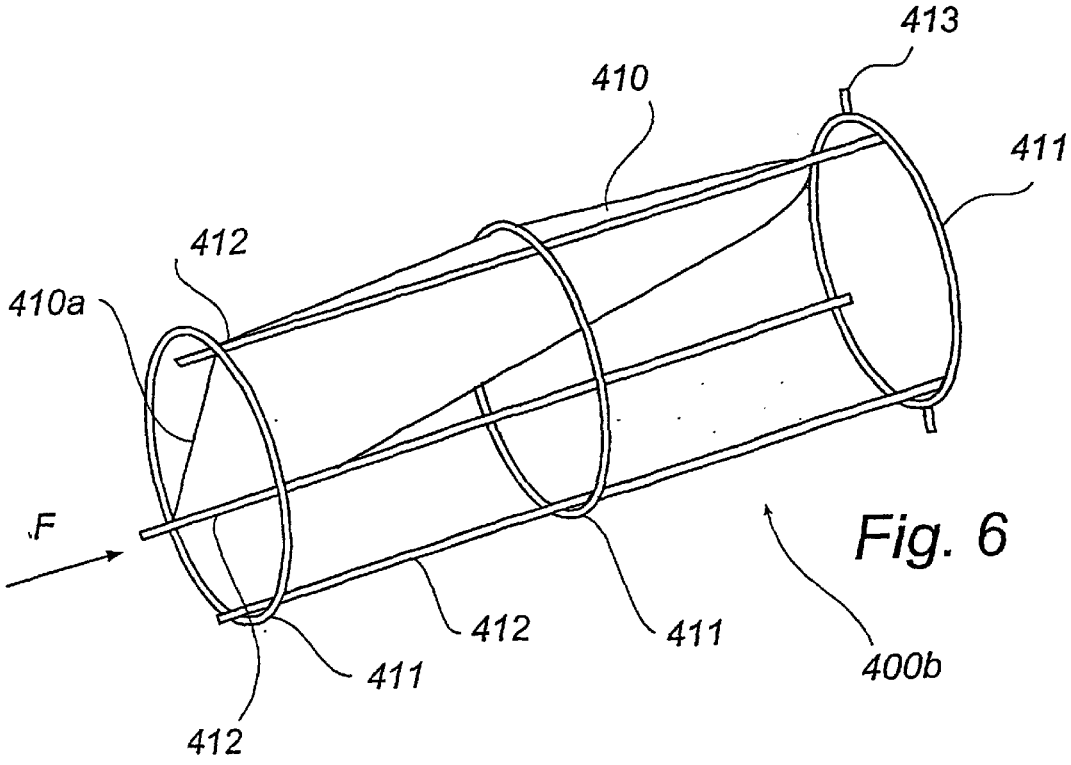
FIG. 6 shows a variant of the flow distribution device shown in FIG. 5.
Figure 7:
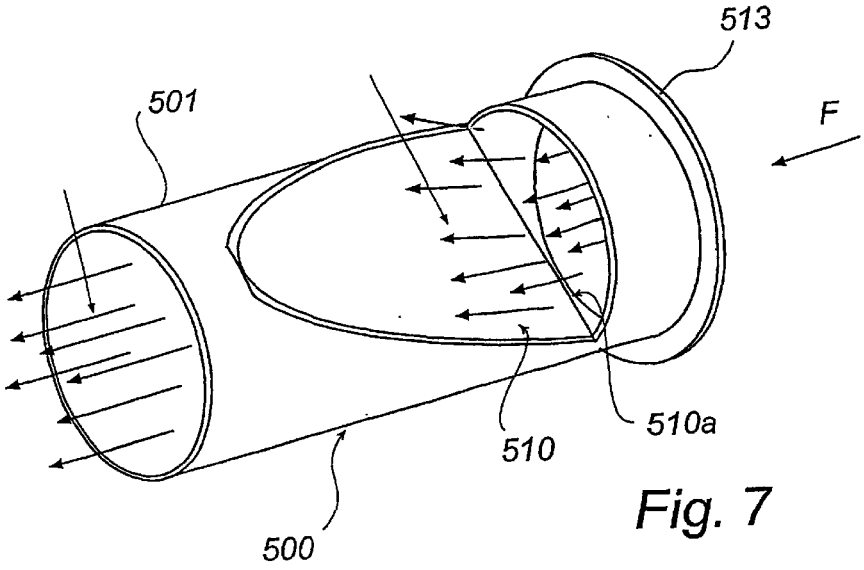
FIG. 7 shows a flow distribution device according to a second preferred embodiment.
Figure 8:
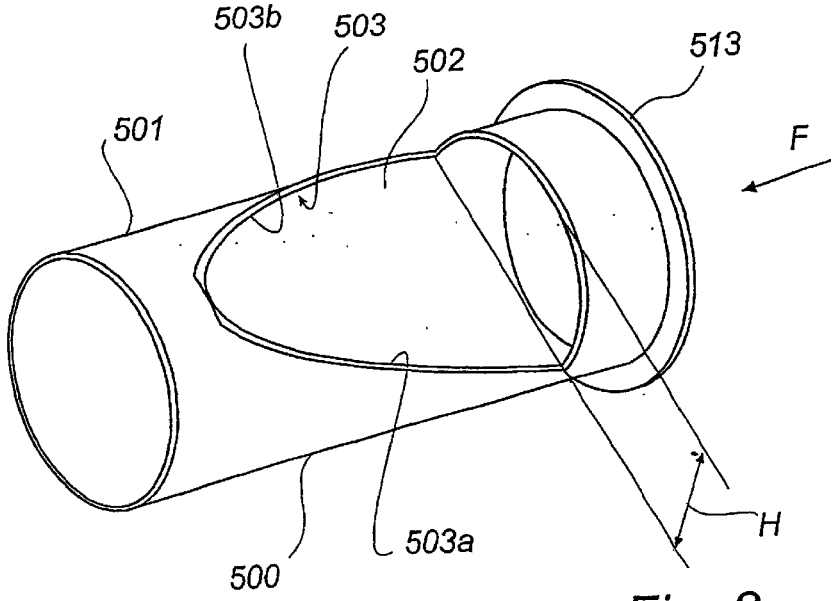
FIG. 8 shows part of the flow distribution device in FIG. 7.
Figure 9:
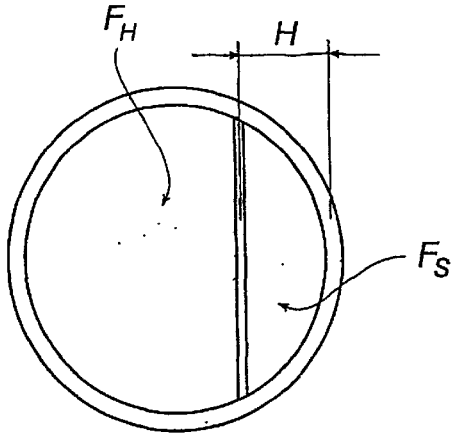
FIGS. 9–11 illustrate the function of the preferred embodiments of the flow distribution device in different two-phase flows.

FIG. 5 and FIG. 6 show two different variants of the flow distribution device 400 deflecting different amounts of the flow in the primary duct.

Figure 18:
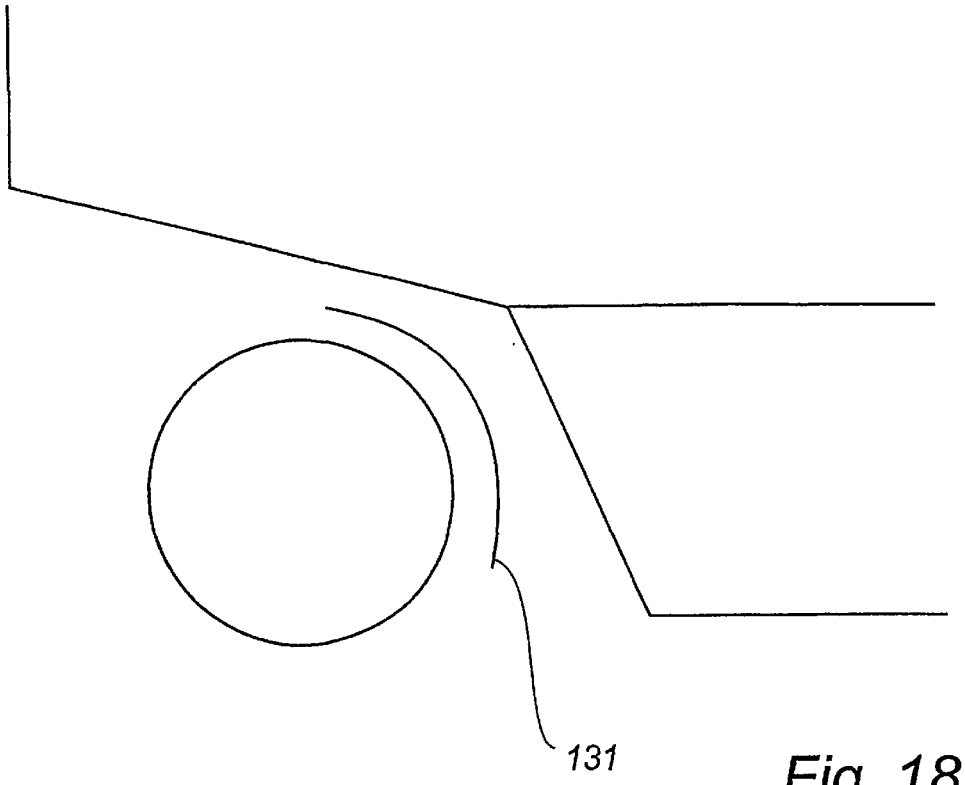
FIGS. 18 and 19 are two schematic illustrations of different gasket configurations between a primary duct and a secondary duct.
Figure 19:
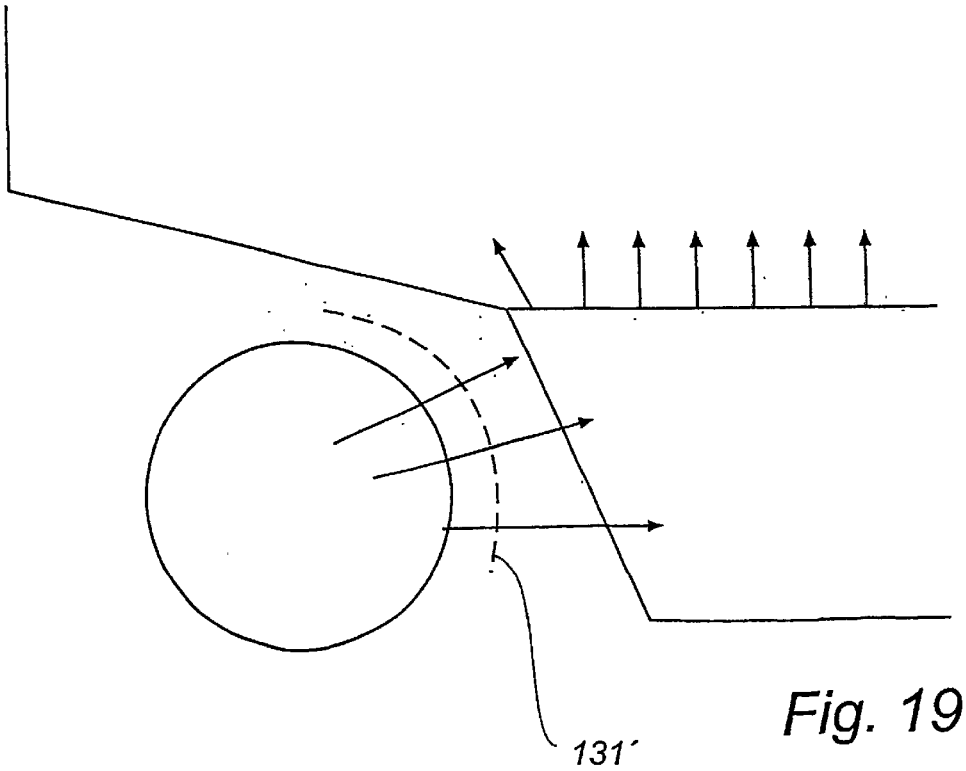

Another way of providing the limited extension of the flow passage between the primary and secondary ducts is to arrange gaskets 131 around the primary ports 110*a–b* in a number of plate interspaces 250 (see FIG. 18) and only allow the first fluid to flow between the primary port and the secondary port in a limited number of plate interspaces. By using partially recessed or cutout gaskets 131' (see FIG. 19) adjacent to the flow passage portion, the flow in the flow passage between the primary duct and the secondary duct can be regulated. The level of recessing or the amount of cutout gasket 131' determines the deflection and thus corresponds in terms of function to the selection of inclination, extension and degree of radial insertion for the inclined ramp in the flow distribution device. Because the flow passage only extends across a flow passage portion of a relatively limited extension, this construction can also be used in some two-phase applications.

As appears from FIGS. 14–17, 20 it is preferred that the plate pack of the plate heat exchanger is divided into a number of sections. The sectioning is done by the secondary duct 240, 340, 640 being divided into a number of sections, each communicating with a number of plate interspaces. Each section of the secondary duct serves a certain number of plate interspaces. One way of performing the division of the secondary duct 240, 340, 640 is to occasionally arrange a plate 100, in which the secondary port 110*c* has not been stamped out.

This design is particularly suited for long plate heat exchangers. The division of the secondary duct means that the tendency of the flow passage and the flow distribution device to create an equalizing flow in the secondary duct can be used also in long plate heat exchangers.

Figure 13:
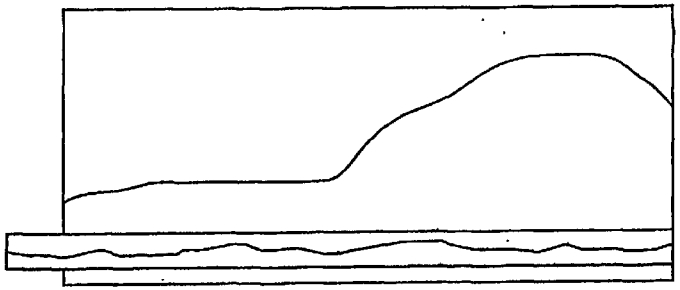
FIGS. 12–15 illustrate how the flow is distributed along the length of the plate heat exchanger according to prior art (FIGS. 12–13) and according to a preferred embodiment of the invention (FIGS. 14–15).
Figure 15:
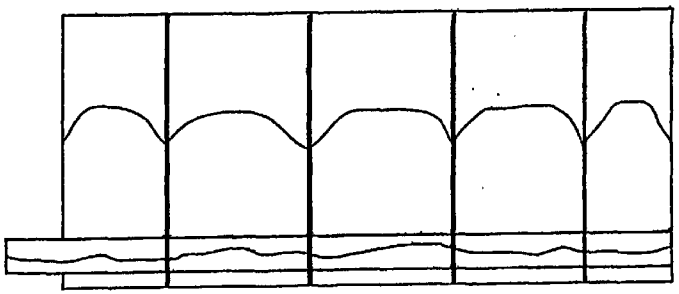
Figure 12:
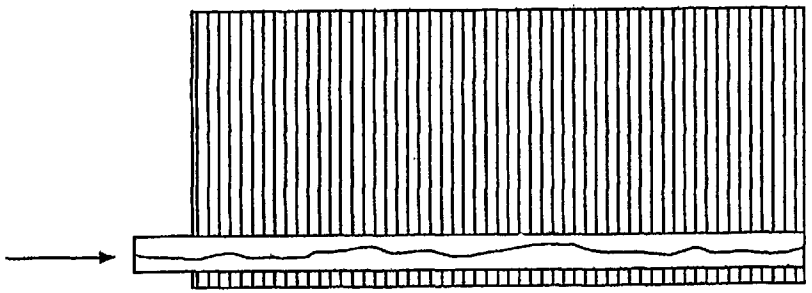
Figure 14:
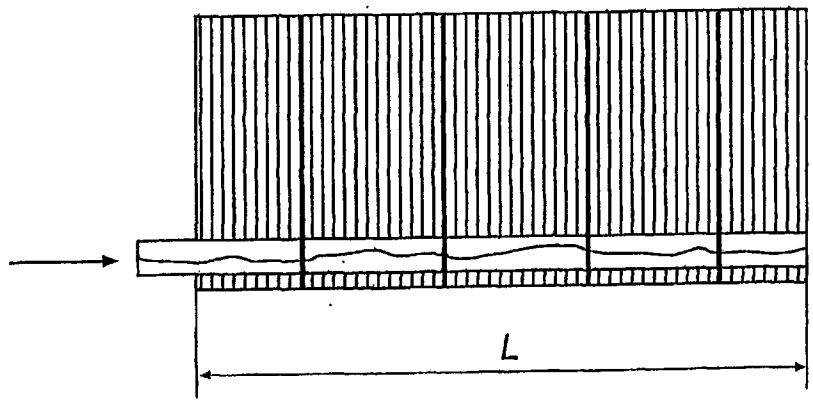

A conventional plate heat exchanger, which is not sectioned, is shown in FIG. 12. FIG. 13 illustrates the distribution tendency of the liquid flow along the plate heat exchanger, particularly in two-phase applications. The corresponding tendency in a sectioned plate heat exchanger is shown in FIGS. 14 and 15. Owing to the sectioning, an altogether better flow distribution along the length of the plate heat exchanger is obtained.

In addition, the sectioning means that you can allow a less satisfactory distribution in each of the sections and still obtain a better overall distribution. However, owing to the sectioning it becomes easier to obtain a satisfactory distribution for each of the sections, which means that the overall distribution is considerably better than in a non-sectioned long plate heat exchanger.

FIG. 16 shows a configuration of two primary ducts 230*a–b* and a secondary duct 240 supplemented with flow distribution devices 231 and sectioning of the secondary duct 240 in two sections 240*a–b*. In this embodiment, each of the primary ducts 230*a–b* communicates with each of the secondary duct sections 240*a–b* via two flow passage portions, adjacent to which flow distribution devices are arranged in the primary ducts 230*a–b*. It is worth noting that the different passage portions leading from a primary duct are located at a distance P from each other. In addition, the flow passage portions leading from one primary duct 230*a* are displaced relative to the corresponding flow passage portion leading from the other primary duct 230*b*. This allows an equalizing flow in the different sections 240*a–b* of the secondary duct 240 to be obtained.

FIG. 17 shows a configuration of two primary ducts 330*a–b* and a secondary duct 340, which is divided into two sections 340*a–b*. The first section 340*a* of the secondary duct 340 is supplied with a fluid from one primary duct 330*b*, and the second section 340*b* of the secondary duct 340 is supplied with a fluid from the other primary duct 330*a*. In this embodiment, flow passage portions 331 are shown, which are defined by the absence of all-sealing gaskets (see FIG. 19). The flow passage portions 331 are located in the rear part of the secondary duct sections 340*a–b*, relative to the flow direction F, to provide a satisfactory equalization of the flow in the secondary duct sections 340*a–b*. The primary duct 340*a* serving the rear section 340*b* of the secondary duct is separated from the front section 340*a* of the secondary duct by means of gaskets 332 in the plate interspaces. The sections 340*a–b* of the secondary duct 340 are separated from each other by means of a plate 100', in which no secondary port has been stamped out (cf. secondary port 110*c* in FIG. 2). The rear portion of the primary duct 330*b* serving the front section 340*a* of the secondary duct is partly separated from the rear section 340*b* of the secondary duct by means of gaskets 332 and partly separated from the front portion of the primary duct 330*b* by means of the plate 100'. To ensure that the plate pack supports the fluid pressure, a small flow is conveyed to the rear portion through small openings in the plate 100' as well as from the secondary duct 340*b* that runs parallel to said portion. Alternatively, all gaskets between the primary duct 330*b'* and the secondary duct 340*b* may be removed.

Without this delimitation relative to the secondary duct 340 and the front portion of the primary duct 330*b* there would be a stagnant fluid in the rear portion 330*b*∝0 of the primary duct 330*b*.

Figure 20:
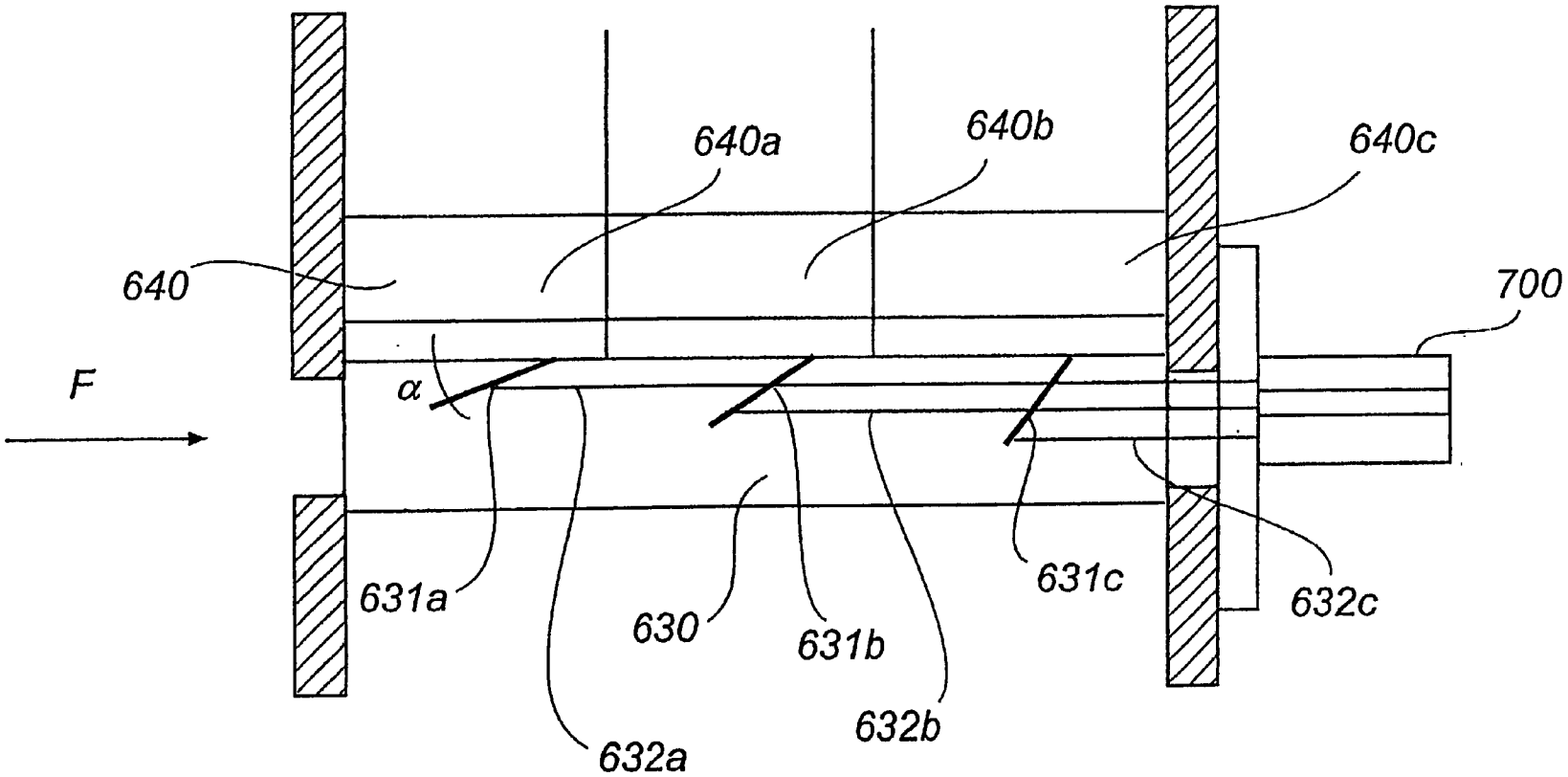
FIG. 20 shows an embodiment of the invention, in which the inclination of the deflecting ramps may be varied.

FIG. 20 shows a configuration of a primary duct 630 and a secondary duct 640, said secondary duct being divided into three sections 640*a–c*, each serving a number of plate interspaces. This configuration comprises three flow distribution devices 631*a–c*, which are arranged in the primary duct 630 and which are each intended to deflect part of the fluid flow in the primary duct 630 to the respective sections 640*a–c* of the secondary duct.

As illustrated in the figure, each of the inclined ramps of the flow distribution devices 631*a–c* has a different extension into the primary duct. The distance by which the different inclined ramps extend into the primary duct 630 increases in the direction of the flow F in the plate heat exchanger. The first flow distribution device 631*a* deflects a certain amount of the fluid flow in the primary duct 630. To ensure that the same flow amount is conveyed to the second section 640*b*, the second flow distribution device 631*b* deflects a larger share of the remaining fluid flow in the primary duct 630. The next flow distribution device 631*c* deflects in turn an even larger share of the further reduced remaining flow in the primary duct 630.

This action obtained by means of different insertion distances of the flow distribution device can also to some extent be obtained in the gasket variant by varying the size of the flow passage portions along the length of the plate heat exchanger. A small flow passage portion thus corresponds to a small insertion distance and a large flow passage portion corresponds to a larger insertion distance.

In the embodiment shown in FIG. 20, the flow distribution devices may be set or adjusted. This adjustability is achieved for example by the inclined ramps having a variable angle of inclination. The plate heat exchanger comprises a control unit 700, which includes the necessary control equipment, and actuating means 632*a–c*. In FIG. 20, the actuating means 632*a–c* are shown as elongate struts that are actuated by some kind of motor or piston in the control unit. It is possible to achieve the adjustability in a number of other ways, for example by using servomotors supporting the inclined ramps or by using wire ropes instead of the struts shown, combined with some kind of back spring suspension of the ramps allowing them to assume a certain angle of inclination a.

By making the flow distribution devices adjustable, one and the same plate heat exchanger may be used within a considerably larger capacity range than conventional plate heat exchangers. Depending on the total incoming fluid flow, smaller or larger amounts can be deflected to the different sections of the plate heat exchanger. It is even possible to shut off one or more sections of the plate heat exchanger in order to handle a different capacity requirement or to clean them by closing the flow distribution devices 631*a–c* completely. In a conventional plate heat exchanger, which is not provided with primary/secondary ducts or sections, the fluid flow otherwise tends to be unevenly distributed if the fluid flow supplied does not correspond to the fluid flow for which the heat exchanger was designed.

It will be appreciated that a number of modifications to the embodiments described herein are possible within the scope of the invention, as defined in the following claims.

For example, the different configurations of primary and secondary ducts, flow distributors (fixed and adjustable) whose insertion distance may or may not be increased along the length of the plate heat exchanger, recessed or partially cutout gaskets, may be varied according to current requirements for different applications.

What is claimed is:

1. A plate pack for a plate heat exchanger comprising a number of heat transfer plates (100), each plate having a heat transfer portion (C) and a number of through ports (110*a–d*, 120*a–f*), said plates (100) interacting in such manner, that a first flow duct is formed between the plates (100) in a plurality of first plate interspaces (250) for a first fluid flow and a second flow duct is formed between them in a plurality of second plate interspaces (250) for a second fluid flow, and that the ports (110*a–d*, 120*a–f*) form at least one inlet duct and at least one outlet duct (110*a–d*, 102*a–f*; 230, 240; 330, 340; 630, 640) for each of the flow ducts, wherein the at least one inlet duct of at least the first flow duet compxises at least two primary ducts (110*a–b*; 230*a–b*; 330*a–b*; 630*a–b*) arranged to receive the first fluid flow, which is intended for the first flow duct, and at least one secondary duct (110*c*), which has an elongated shape and extends across at least half the width of the plate, and which communicates via flow passage with the primary ducts (110*a–b*) and the first flow duct and which is arranged to receive said first fluid flow from the primary ducts (110*a–b*) and to convey this flow to the first flow duct.

2. A plate pack according to claim 1, wherein each of the primary ducts extends through the whole plate pack.

3. A plate pack according to claim 1, wherein the at least one secondary duct extends through the whole plate pack.

4. A plate pack according to claim 1, wherein the at least one secondary duct is divided into a number of separate sections (240*a–b*; 340*a–b*; 640*a–c*), each cxtending only through part of the plate pack.

5. A plate pack according to claim 4, wherein one of the primary ducts communicates with a first section of the at least one secondary duet and the other primary duct communicates with a second section of the at least one secondary duct.

6. A plate pack according to claim 1, wherein the flow passage between at least one of tbe primary ducts and the at least one secondary duet along the primary ducts and the at least one secondary duct has an extension that is smaller than the extension of each of the ducts along each other.

7. A plate pack according to claim 1, wherein there is only one flow passage between each of the primary ducts and the at least one secondary duct.

8. A plate heat exchanger, comprising at least one plate pack according to claim 1.

9. A plate pack for a plate heat exchanger comprising a number of heat transfer plates (100), each plate having a heat transfer portion (C) and a number of through ports (110*a–d*, 120*a–f*), said plates (100) interactins in such manner, that a first flow duet is formed between the plates (100) in a plurality of first plate interspaces (250) for a first fluid flow and a second flow duct is formed between them in a plurality of second plate interspaces (250) for a second fluid flow, and that the ports (110*a–d*, 120*a–f*) form at least one inlet duct and at least one outlet duct (110*a–d*, 102*a–f*; 230, 240; 330, 340; 630, 640) for each of the flow ducts, wherein the at least one inlet duct of at least the first flow duct comprises at least two primary ducts (110*a–b*; 230*a–b*; 330*a–b*; 630*a–b*) anatiged to receive the first fluid flow, which is intended for the first flow duct, and at least one secondary duct (110*c*), which communicates via flow passage with the primary ducts (110*a–b*) and the first flow duct and which is azianged to receive said first fluid flow from the primary ducts (110*a–b*) and to convey this flow to the first flow duct and wherein a flow distribution device (231; 400; 500; 631*a–c*) is an-anged in at least one of the primary ducts (110*a–b*; 230*a–b*; 630) for deflection of part of the first fluid flow in the at least one primary duct to the at least one secondary duct (110$^c$; 240; 640) via said flow passage.

10. A plate pack according to claim 9, wherein the flow distribution device delimits, along part of the at least one primary duct, a section of the cross-sectional area of the at least one primary duct in such manner that this cross-scetional area decreases along the at least one primary duct in the flow direction of the first fluid flow.

11. A plate pack according to claim 9, wherein the flow distribution device comprises a tubular body (400*a–b*; 501), which surrounds an inclined ramp (410; 510) having a front portion and a rear portion.

12. A plate pack according to claim 11, wherein the front portion (410*a*; 510*a*) of the inclined ramp (410; 510) is located at a distance from the duct wall of the at least one primary duct.

13. A plate pack according to claim 11, wherein the rear portion of the inclined ramp connects to the duct wall of the at least one primary duct adjacent to the flow passage between the at least one primary duct and the at least one secondary duct.

14. A plate pack according to claim 11, wherein the inclined ramp of the flow distribution device has a dcflecting edge (410*a*; 510*a*), which is oriented in a direction opposite to the flow of the first fluid.

15. A plate pack according to claim 14, wherein the deflecting edge (410*a*; 510*a*) has a substantially vertical extension.

16. A plate pack according to claim 14, wherein the inclined ramp comprises a substantially flat, semi-elliptic sheet.

17. A plate pack according to claim 16, wherein the deflecting edge (410*a*; 510*a*) is defined by a main ellipse axis of the sheet.

18. A plate pack according to claim 11, wherein the extension of the inclined ramp (410; 510) along the primary duct is greater than its maximum extension across the at least one primary duct.

19. A plate pack according to claim 11, wherein the body comprises an open, tubular cage structure (400*a–b*), which surrounds and supports the inclined ramp (410).

20. A plate pack according to claimA wherein the body comprises a pipe (501), which surrounds the inclined ramp (510) and which is provided with an opening (502) in its circumferential surface (501), the inclined ramp (510) being connected to said opening (502).

21. A plate pack according to claim 9, wherein the flow distribution device comprises a number of outwardly extending connecting means (413, 513), said connecting means being arranged to be fixed between the plates in their abutment against each other around the at least one primary duct.

22. A plate pack according to claim 9, wherein the flow distribution device has an external shape, which substantially corresponds to the internal shape of the at least one primary duct.

23. A plate pack according to claim 9 wherein at least one flow distribution device is arranged in each of the primary ducts.

24. A plate pack according to claim 9, wherein the flow distribution device is adjustable in such manner tbat the part of the first fluid flow in the at least one primary duct deflected by the flow distribution device to the at least one secondary duct via said flow passage is adjustable.

25. A plate pack according to claim 24, wherein each of the primary ducts communicates with different portions of the secondary duct.

26. A heat transfer plate for use in a plate pack for a plate heat exchanger, said plate (100) having a heat transfer portion (C) and at least two primary through ports and at least one secondary through port (110*a–d*, 120*a–f*), the plate (100) being arranged to interact with other plates (100) in a plate pack in such manner, that a first flow duct is formed between the plates (100) in a number of first plate interspaces (250) and a second flow duct is formed between them in a number of secoud plate interspaces (250), and that the ports (110*a–d*, 120*a–f*) form at least one inlet duct and at least one outlet duet for each of the flow ducts, wherein the at least two primary ports (110*a–b*) are ranged to form, together with corresponding primary ports of other heat transfer plates in said plate pack, the at least two primary ducts constituting one of the at least one inlet ducts intended to receive a fluid flow for the first flow duct, and the at least one secondary port (110*c*) is arranged to form, together with corresponding secondary ports of said other plates, at least one secondary duct which has an elongated shape and extends across at least half the width of the plate and is intended to communicate via a flow passage wit said primary ducts and said first flow duct.

27. A heat transfer plate according to claim 26, wherein the at least one secondary port (110*c*) is arranged between the primary ports (110*a–b*) and the heat transfer portion (C).

28. A heat transfer plate according to claim 26, wherein the secondary port (110*c*) has a larger cross-sectional area than each of the primary ports (110*a–b*).

* * * * *